United States Patent [19]

Henderson

[11] Patent Number: 4,457,369

[45] Date of Patent: Jul. 3, 1984

[54] PACKER FOR HIGH TEMPERATURE HIGH PRESSURE WELLS

[75] Inventor: William D. Henderson, Frisco, Tex.

[73] Assignee: Otis Engineering Corporation, Dallas, Tex.

[21] Appl. No.: 217,228

[22] Filed: Dec. 17, 1980

[51] Int. Cl.[3] ..... E21B 33/129

[52] U.S. Cl. ..... 166/125; 166/134; 166/177; 166/217; 277/235 R

[58] Field of Search ..... 166/119, 134, 125, 120, 166/179, 196, 216, 206, 217; 294/86.25, 86.24; 277/235 R

[56] References Cited

U.S. PATENT DOCUMENTS

| | | | |
|---|---|---|---|
| 2,261,564 | 11/1941 | Robichaux | 294/86.25 |
| 2,684,119 | 7/1954 | Brown | 277/235 |
| 2,772,740 | 12/1956 | Edwards | 166/216 |
| 3,142,338 | 7/1964 | Brown | 166/120 |
| 3,374,837 | 3/1968 | Page | 166/120 |
| 3,381,752 | 5/1968 | Elliston | 166/120 |
| 3,464,709 | 9/1969 | Furgason et al. | 277/233 |
| 3,631,926 | 1/1972 | Young | 166/134 |
| 3,993,128 | 11/1976 | Braddick | 166/216 |
| 4,156,460 | 5/1979 | Crowe | 166/120 |
| 4,258,926 | 3/1981 | Upton | 166/196 |
| 4,296,806 | 10/1981 | Taylor | 166/120 |

*Primary Examiner*—Pate, III: William F.
*Attorney, Agent, or Firm*—H. Mathews Garland

[57] ABSTRACT

A well packer for high pressure and temperature use having a tubular mandrel, upper and lower slip assemblies in spaced relation on the mandrel and a high temperature and pressure seal assembly including a plurality of annular elements of different elasticities mounted on the mandrel between the slip assemblies. The slip assemblies are arranged so that the lower slip assembly sets first and the upper slip assembly last while the upper slip assembly releases first and the lower slip assembly releases last when pulling the packer. The upper slip assembly includes a collet expander wedge and a support ring for holding the collet wedge expanded and releasing the collet wedge in running and pulling the packer. The packer is designed for temperatures at least as high as 600° F. and pressures of at least 5000 psi.

17 Claims, 16 Drawing Figures

PACKER FOR HIGH TEMPERATURE HIGH PRESSURE WELLS

This invention relates to well tools and more particularly relates to well packers.

The production of wells, especially oil and gas wells, usually requires completion equipment including a well casing in the form of pipe placed in the well and perforated to permit oil and gas production into the well, a production tubing in the form of a pipe string for conducting the oil and gas from the well in the casing, and one or more well packers connected with the tubing for sealing between the tubing and casing. Packers may be of the retrievable type which are installed in a well and may thereafter be pulled back to the surface for servicing and replacing or the packers may be of a permanent type which remain in the well bore and have to be drilled out in the event of re-working a well. Wells, especially deeper wells which are frequently drilled now as oil becomes more difficult to find, provide high temperature and high pressure environments in which packers must function. For example, the temperature may be as high as 600° F. at a pressure as high or higher than 5000 psi. Packers which have heretofore been available to satisfy such needs have been quite expensive to manufacture and often have not satisfied the requirements.

It is therefore a principal object of the present invention to provide a new and improved well tool, more particularly, a new and improved well packer.

It is another object of the present invention to provide a well packer of the retrievable type.

It is another object of the present invention to provide a retrievable type well packer which is operable at high temperatures and pressures.

It is another object of the present invention to provide a well packer which may be manufactured at a lower cost than currently available packers of the same type.

It is another object of the present invention to provide a retrievable type high temperature well packer which utilizes parts requiring a minimum amount of millwork.

It is another object of the present invention to provide a seal assembly for a well tool such as a packer to seal between the tool and adjacent wall surface in the well bore and which is operable to retain high fluid pressures at high temperatures.

It is another object of the invention to provide a well packer having both upper and lower slips each of which comprises a one piece C-shaped member.

In accordance with the invention, there is provided a well packer having a tubular mandrel, upper and lower slips in spaced relation on the mandrel each comprising a one piece C-shaped member, means on the mandrel for expanding each of the slips, means for locking the upper slips in expanded condition, and an expandable seal assembly on the mandrel between the slips for sealing around the mandrel with a surrounding surface. Further, in accordance with the invention, there is provided a high temperature, high pressure seal assembly for a well packer including a central elastic element between plastic less elastic members and end assemblies including longitudinally collapsible members, and radially expandable back-up shoes and internal seal rings to prevent extrusion of the elastic and plastic members along the packer mandrel and along the wall surface with which such members seal around the packer mandrel.

The objects and advantages of the present invention will be more apparent from the following detailed descriptions of preferred embodiments of the invention in conjunction with the accompanying drawings wherein:

FIG. 1 is a longitudinal view in elevation and section of a well packer embodying the features of the invention set in the casing of a well bore providing a seal with the casing wall and a tubing string extending to the packer;

FIGS. 2A through 2C inclusive taken together form a longitudinal view in section and elevation of the well packer and seal assembly of the invention showing the seal assembly relaxed and the packer slips retracted as the packer is run into a well bore;

Figure 1:
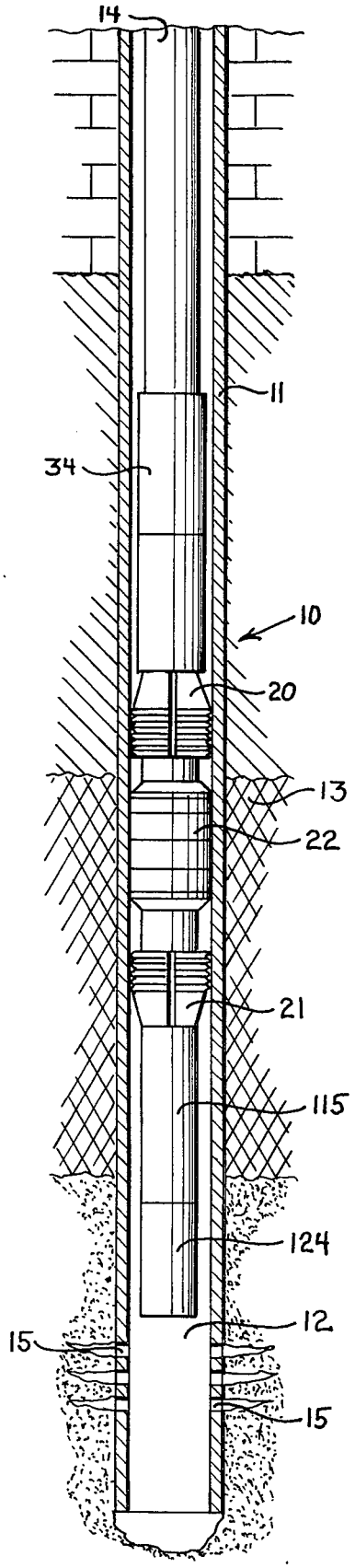
Figure 7:
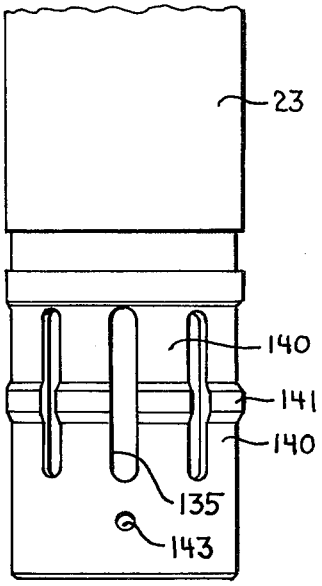
Figure 8A:
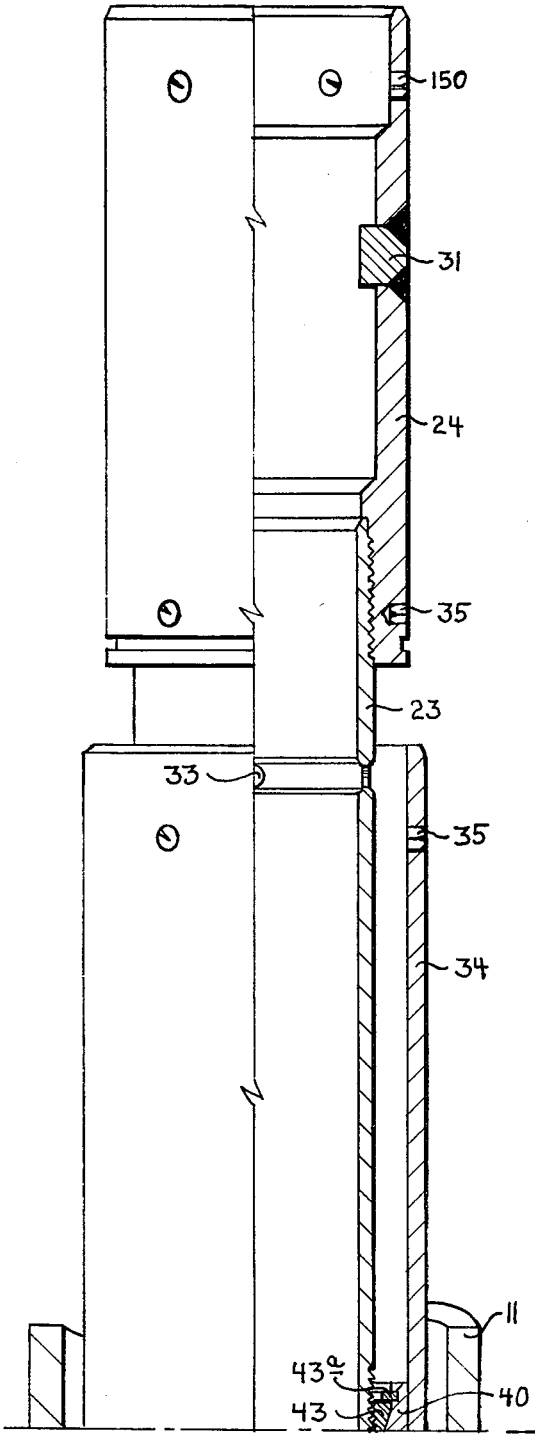
Figure 8B:
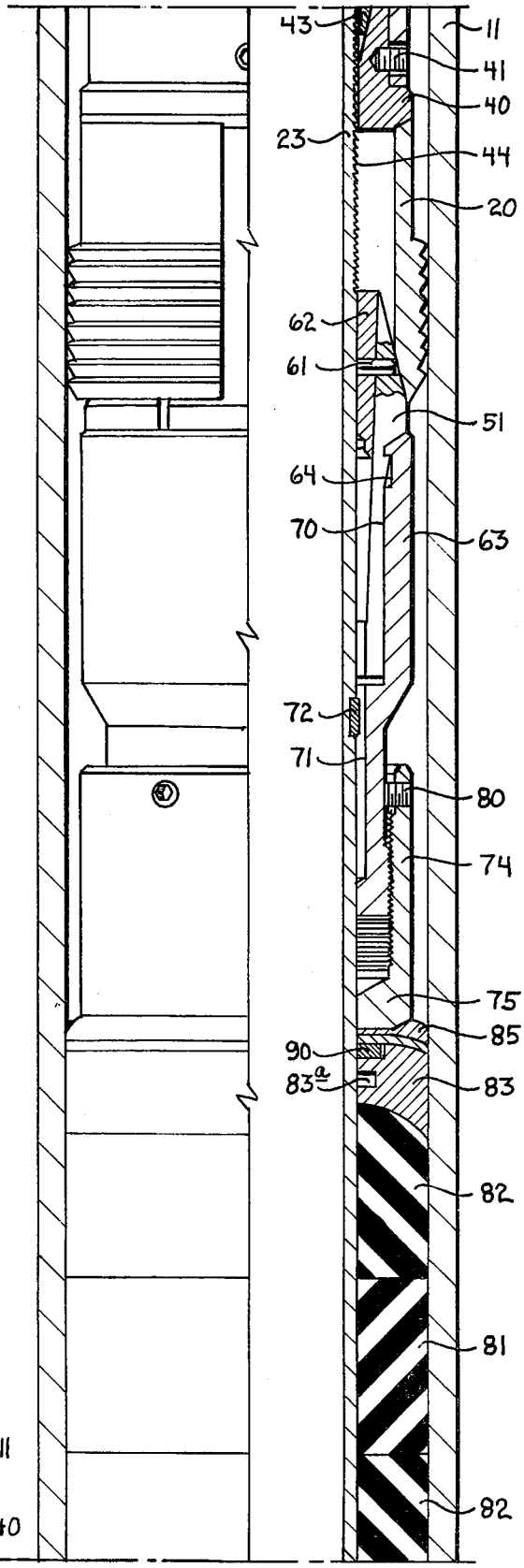
Figure 8C:
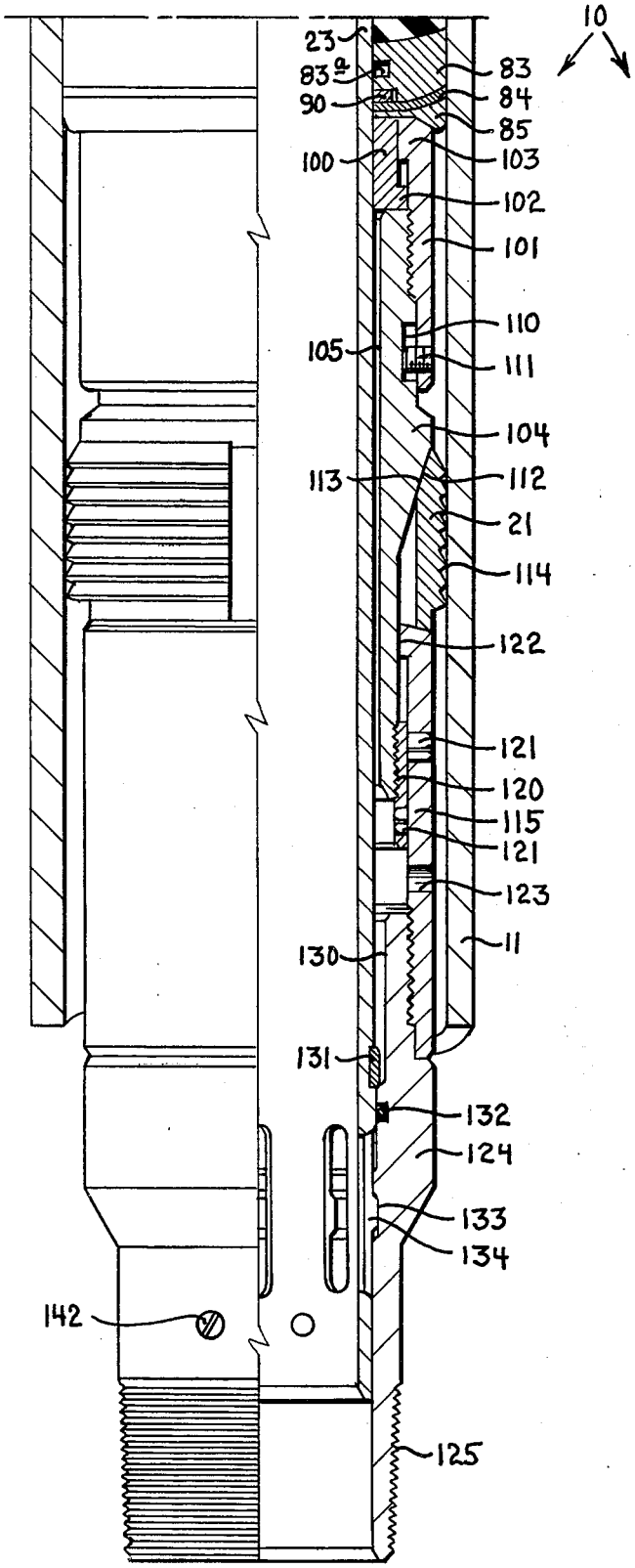
Figure 9A:
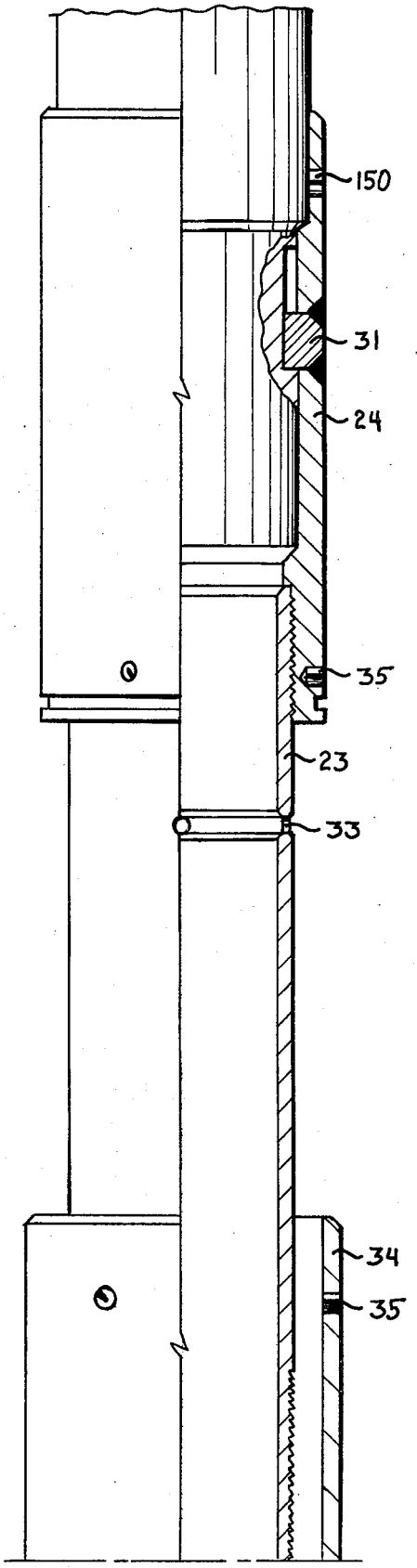
Figure 9B:
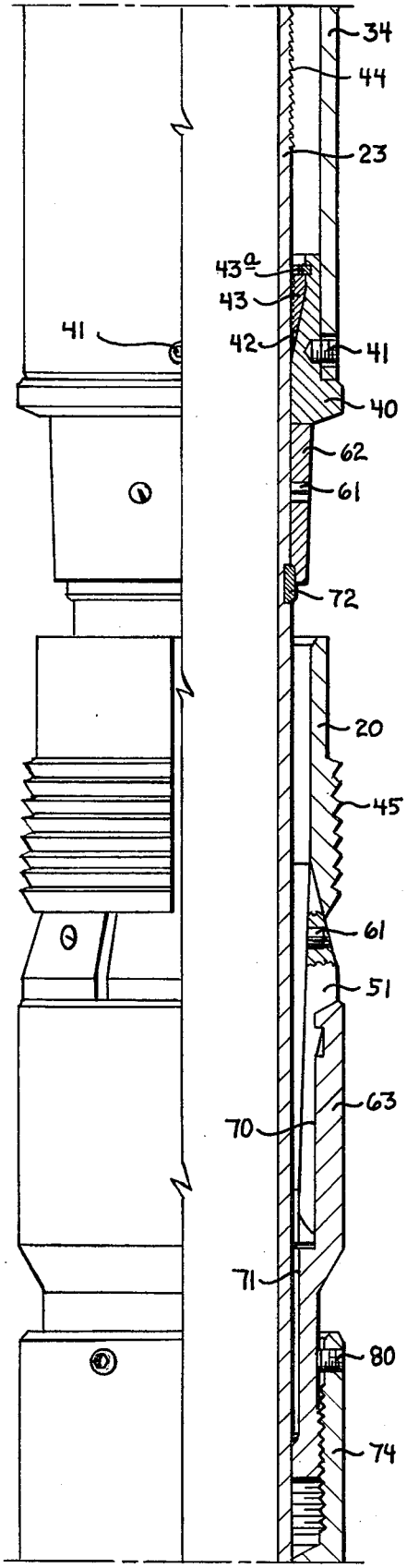
Figure 9C:
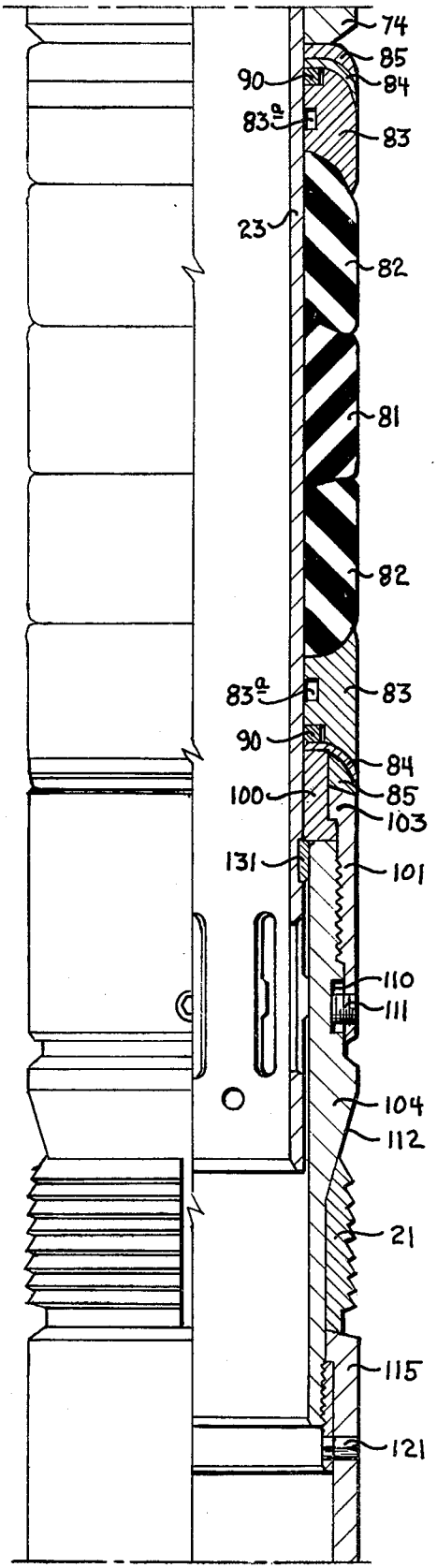
Figure 9D:
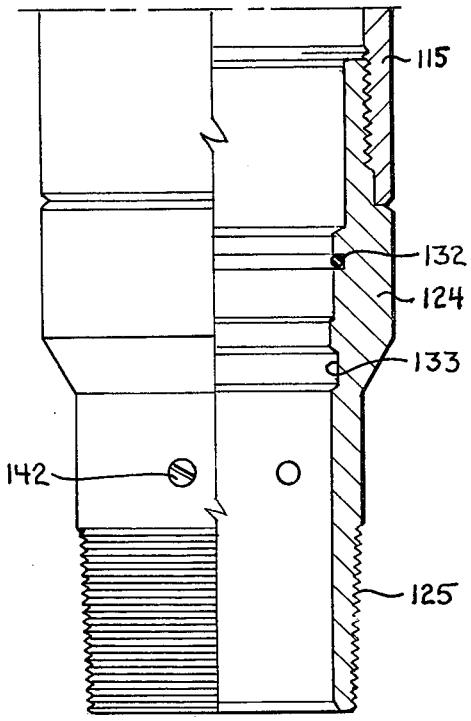

FIG. 7 is a fragmentary end view in elevation of the lower end portion of the packer mandrel showing the collet fingers releasably locking the packer mandrel with the bottom sub of the packer, FIGS. 8A through 8C inclusive form a longitudinal view in section and elevation showing the packer set in the casing of a well bore as illustrated in FIG. 1 with the seal assembly expanded into sealing relation with the casing wall; and FIGS. 9A through 9D inclusive form a longitudinal view in section and elevation showing the locking slips released from the casing wall and the various component parts of the packer at relative positions at which the packer is retrieved from a well bore.

Referring to FIG. 1, a well packer 10 embodying the features of the invention is set in the casing 11 lining a well bore 12 drilled in an oil and gas producing formation 13. The packer is connected with a production tubing string 14 leading to a well head, not shown, at the surface for conducting produced fluids from the formation to the well head. The casing is perforated at 15 allowing well fluids such as oil and gas to flow from the formation through the casing into the well bore. The packer is releasably locked with the casing wall by an upper C-ring slip 20 and a lower C-ring slip 21. A seal assembly 22 on the packer is expanded against the casing wall forming a fluid-tightseal around the packer so that formation pressure is held in the well bore below the seal assembly and formation fluids are forced into the bore of the packer to flow to the surface through the production tubing string 14. The packer is run into the well bore and set by means of a suitable running tool which first sets the lower slip 21, expands the seal assembly 22, and then sets the upper slip 20. The seal assembly is capable of retaining an effective seal at temperatures as high as at least 600° F. and pressures of at least 5000 psi. The packer is readily retrieved from the well bore by means of a suitable pulling tool which first releases the upper slip allowing the seal assembly to relax and thereafter releases the lower slip freeing the packer for pulling to the surface.

Figure 2A:
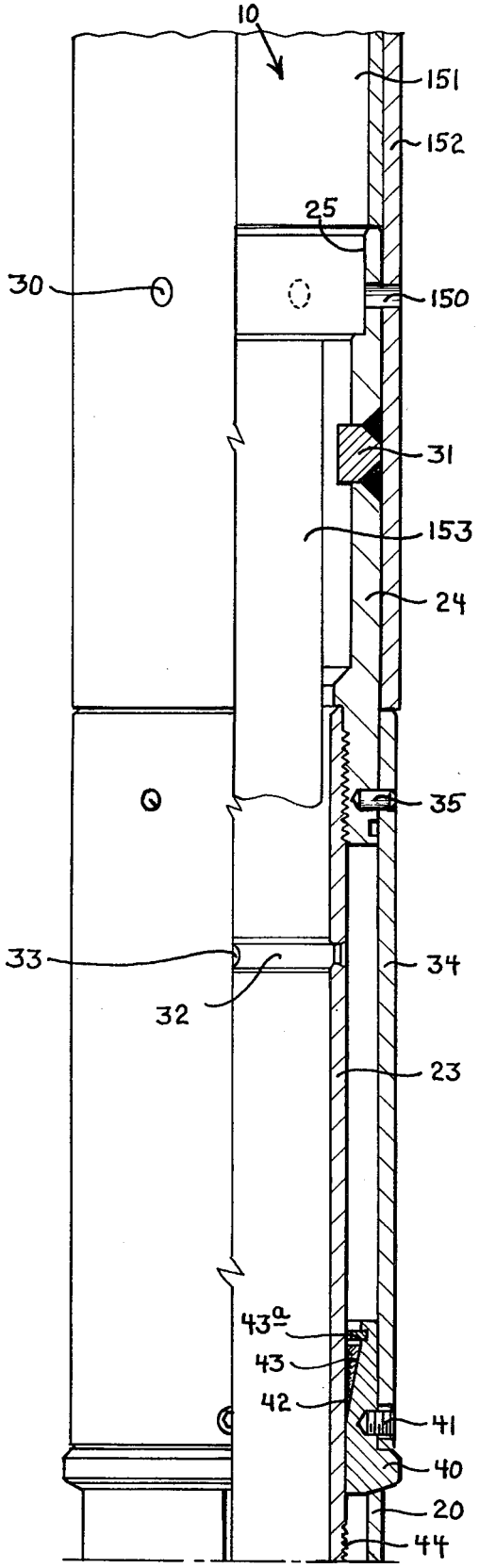
Figure 2B:
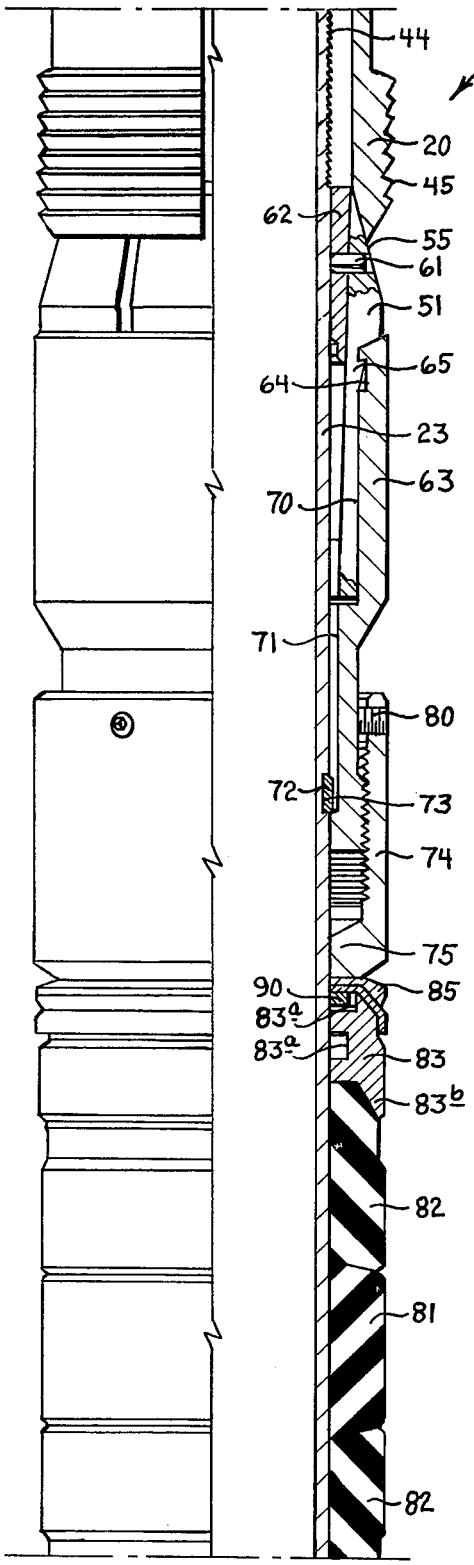
Figure 2C:
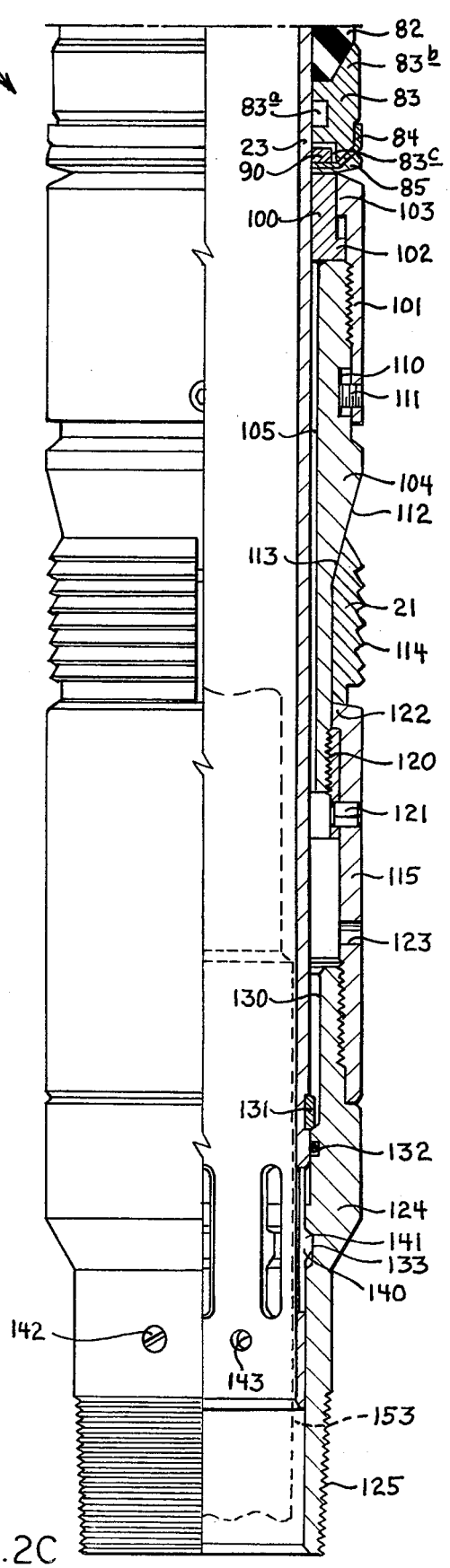

Referring to FIGS. 2A–2C showing the structural details of the packer 10, the packer includes a longitudinal tubular mandrel 23 on which the upper and lower slips 20 and 21 and the packing assembly 11 are mounted. The mandrel is threaded along an upper end portion into a top sub 24 which is provided with a counter bore 25 having a plurality of circumferentially spaced shear pin holes 30 for releasable connection of a running tool. An internal lug 31 is secured in the top sub below the counter bore for engagement with a J-slot of a pulling tool. Below the threaded upper end portion, the mandrel 23 has an internal annular recess 32 opening into a plurality of circumferentially spaced ports 33 which may be used to conduct hydraulic fluid in a form of the packer fitted for hydraulic setting.

Figure 3:
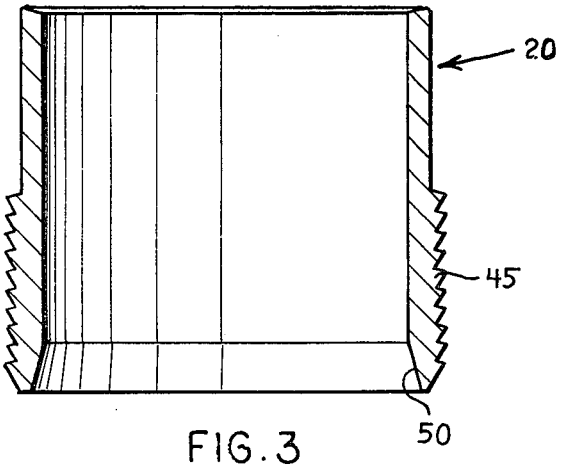
FIG. 3 is a view in section of the upper C-ring slip of the packer.
Figure 6:
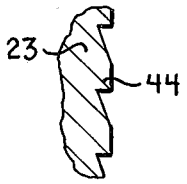
FIG. 6 is an enlarged fragmentary view in section showing external threading along the packer mandrel which aids in locking the upper C-ring slip.
Figure 4:
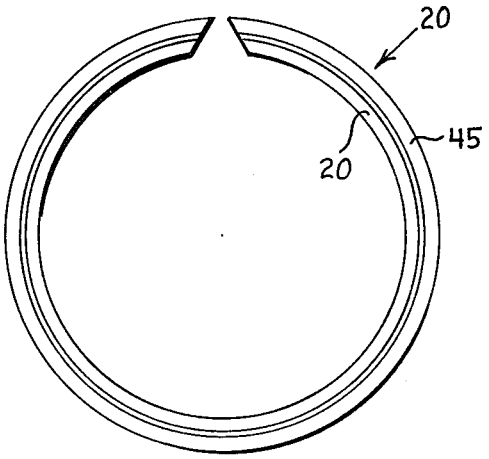
FIG. 4 is an end view of the C-ring slip shown in FIG. 3.
Figure 5:
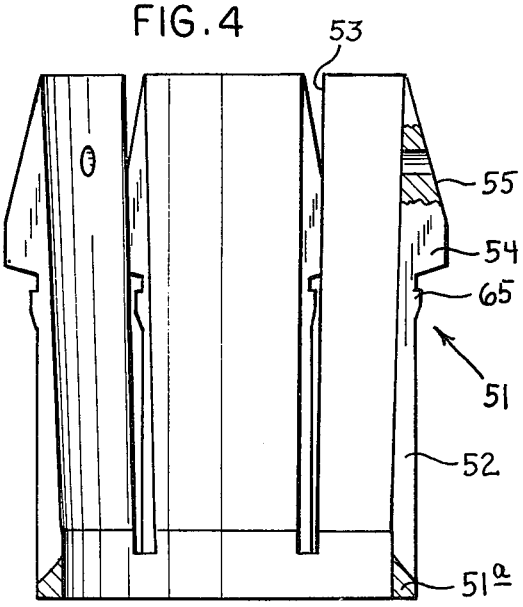
FIG. 5 is a longitudinal view in section and elevation of the collet wedge of the packer which expands the C-ring slip of FIGS. 3 and 4.

Referring to FIGS. 2A and 2B, a setting sleeve 34 is mounted in concentric spaced relation on the upper end portion of the mandrel 23. The upper end portion of the sleeve telescopes over and is secured with the lower end portion of the sub 24 by circumferentially spaced shear pins 35. An annular slip support 40 is slideably mounted on the mandrel 23 telescoped into the lower end of the setting sleeve 34 secured with the setting sleeve by circumferentially spaced set screws 41. The slip support 40 has an internal tapered slip segment support bowl 42 which holds a plurality of circumferentially spaced slip segments 43 each of which has a tapered outer surface to fit the bowl surface and has a serrated or toothed inner surface for locking engagement along the mandrel 23 to lock the upper slip 20 when the packer is set. The mandrel 23 as illustrated in FIGS., 2A and 6 has an external buttress thread 44 which is engaged by the locking slips 43 when the upper slip 20 is set to prevent the locking slips from moving upwardly along the mandrel surface. The upper slip 20 is mounted on the mandrel below the support 40. As seen in FIGS. 2A, 3, and 4, the upper slip 20 is an integral C-shaped member having a plurality of external longitudinally spaced teeth 45 which engage the inner wall of the casing 11 when the slip is expanded. The teeth cover approximately the lower external half of the slip member. The slip is made of a hard, heat-treated metal so that the teeth may readily bite into the casing surface when the packer is set and sufficiently resilient that the one piece slip may be expanded for setting and will readily contract when released. The slip has a lower internal annular flared surface 50 which aids in expanding the slip when the slip is driven downwardly against a collet wedge 51 shown in FIG. 2A and in further detail in FIG. 5. The lower end portion of the slip telescopes over the upper end portion of the collet wedge. As seen particularly in FIG. 5, the collet wedge is a one piece member formed by a base ring 51*a* and a plurality of integral circumferentially spaced parallel collet fingers 52. The collet fingers are separated by longitudinal slots 53 which provide sufficient space between the fingers to permit the fingers to expand and contract around the packer mandrel between the setting and release positions of the collet fingers. The upper end portion of each of the collet fingers is provided with an external boss 54 having an outwardly sloping slip expander surface 55 for expanding the slip 20. Three of the collet fingers have shear pin holes 60 for shear pins 61 which releasably lock the upper end portion of the collet with an internal annular collet support ring 62 mounted on the packer mandrel 23 within the collet as shown in FIG. 2A. Each of the collet fingers 52 slope upwardly and outwardly fitting closely around the downwardly and inwardly sloping outer surface of the support ring 62 so that the ring solidly supports the collet fingers on the packer mandrel when the ring is shear pinned in the collet fingers as illustrated in FIG. 2A. The matching sloping surfaces of the support ring and the collet fingers permits ready removal of the ring from within the fingers when the packer is released from a well bore as described in detail hereinafter. The support ring 62 is sized to form a sliding fit along the packer mandrel for relative longitudinal movement between the ring and the packer mandrel during the setting and release of the packer. The slip expander collet wedge 51 telescopes into a wedge housing 63 which has an internal annular locking recess 64 engaged by locking flanges 65 on each of the collet fingers 52 for interlocking the collet wedge with the housing. The lower end faces of each of the collet finger bosses 54 are engageable with the upper end face of the housing as seen in FIG. 2A when the collet fingers are expanded as shown. The upper portion of the housing 63 has a large internal bore 70 into which the collet wedge fits and a reduced lower bore 71 which is sufficiently larger than the outside diameter of the packer mandrel 23 to permit longitudinal movement of a snap ring 72 mounted on the mandrel within the housing. The snap ring engages the support ring 62 in releasing the packer as described in detail hereinafter. Also the base ring of the collet wedge is sufficiently larger than the outside diameter of the packer mandrel to allow movement of the snap ring 72 within the collet wedge during packer release. The snap ring 72 locks in an external annular recess 73 around the packer mandrel. The lower end portion of the housing 63 is threaded into an annular packer element retainer 74 which is sufficiently enlarged and internally threaded along the major upper end portion of the retainer to receive the lower end portion of the housing 63 and is reduced in diameter along a lower end portion providing an annular flange 75 which fits in sliding relation around the packer mandrel 23 as seen in FIG. 2B. A plurality of circurferentially spaced set screws 80 are threaded through the upper end portion of the retainer 74 against the housing 63 locking the housing and retainer together so that the housing and retainer may be screwed together to a particular set position and locked by the screws. It will be noted that the length of the threads within the retainer permits substantial adjustment of the housing in the retainer thereby providing a degree of control over the expansion of the seal assembly 22 when the packer is set.

In accordance with a particularly important feature of the invention, the packing assembly 22 which seals around the packer with the inner wall of the casing 11 is particularly adapted to high temperature, high pressure wells. The particular combination of materials and the structure of the packing assembly especially suits the assembly to such extreme conditions. Referring to FIG. 2B, the packing assembly 22 is a tandem arrangement of annular elements along the packer mandrel 23 including a center element 81, end elements 82 on opposite sides of the center element, retainer shoes 83 at opposite ends of the end elements, back-up shoes 84, shoe supports 85, and anti-extrusion rings 90. All of the packing assembly elements have internal bores sized to form a sliding fit on the packer mandrel. The center element 81 is a soft plastic material capable of functioning under a pressure of at least 5000 psi and a minimum temperature of at least 600° F. without becoming hard and brittle. A suitable such material is a fluorocarbon elastomer. The end elements 82 are formed of a somewhat harder material which may be a 25% glass filled polytetra fluoro ethylene. Similarly such material does not become hard and brittle under the elevated temperatures and pressures for which the packer is designed. The support members 83 are a still somewhat tougher material which may suitably be a 40% glass filled polytetra fluoro ethylene. The support members 83 have a unique design including an internal annular recess or slot 83*a* and an end flange portion 83*b* which forms an outer peripheral flange overlapping the adjacent end element 82. This particular configuration for the support members or retainer shoes 83 permits the shoes to compress longitudinally and expand radially. The internal recesses 83*a* particularly permit the longitudinal compression desired. The back-up shoes 84 are formed of a relatively thin metal sheet which is sufficiently soft and ductile to permit radial expansion allowing the peripheral edges of the shoes to engage the casing wall to aid in preventing any extrusion of the other elements of the seal assembly between the back-up shoes at opposite ends of the assembly. The shoe supports 85 are formed of a soft heat treated metal which is ductile to permit the shoe supports also to somewhat spread radially as the assembly is compressed longitudinally. Each of the retainer shoes 83 also includes an internal annular endwardly opening recess 83*c* in which the anti-extrusion ring 90 is fitted for preventing extrusion between the inner edge of the back-up shoe 84 and the outer surface of the mandrel 23. The anti-extrusion rings 90 are formed of a polyphenylene sulfide which does not bind with the packer mandrel during release of the packer so that the packer mandrel is free to move upwardly for releasing the slips and allowing the relaxation of the seal assembly. Further, the material of the anti-extrusion rings 90 is sufficiently brittle that if a binding force develops the ring will break thereby allowing free movement of the packer mandrel. The particular combination of materials employed in the seal assembly element as well as the configuration of the elements provides a seal assembly which is effective under the elevated temperature and pressures discussed whereas existing similar seal assemblies are not satisfactory under the same operating conditions.

The upper end face of the upper shoe support 85 of the packer element assembly 22 is engageable with the lower end face of the element retainer 74. Similarly, the lower end face of the lower shoe support 85 is engageable with the upper end edges of an annular release ring 100 and a lower retainer ring 101. The release ring has an external annular lower end flange 102 while the element retainer 101 has an upper end internal annular flange 103. Prior to pulling the packer, that is when running the packer in and while the packer is set in a well bore, the flange 102 on the release ring 100 is spaced from the flange 103 within the retainer ring 101 in the relationship shown in FIG. 2B. The release ring 101 forms a close sliding fit on the packer mandrel 23. The retainer cap 101 is threaded on the upper end portion of a lower slip wedge 104 which has a bore 105 which is larger than the outside diameter of the packer mandrel 23 defining an annular space between the packer mandrel and the slip wedge. The slip wedge 104 has an external annular recess 110 below the externally threaded upper end portion of the wedge to receive set screws 111 threaded through the lower end portion of the element retainer 101 to lock the retainer on the slip wedge. The locking recess 110 on the slip wedge is sufficiently wider than the set screws to permit a degree of longitudinal adjustment of the retainer 101 on the slip wedge. This adjustment in cooperation with the adjustment permitted upper element retainer 74 determines the extent to which the packer element assembly is expandable in setting the packer.

Referring to FIG. 2C, the slip wedge 104 has a conical downwardly sloping expander surface 112. The lower slip 21 is fitted on the slip wedge with an internal upwardly flared expander surface 113 in the slip being engageable by the expander surface 112 on the slip wedge 104. The lower slip 21 is a one-piece C-shaped member having external teeth 114 for gripping the inner wall of the well casing 11 when the lower slip is expanded. The lower slip is basically identical to the upper slip 20 except that the upper slip has an upwardly extending skirt which is not present on the lower slip. An end elevation view of the upper end of the lower slip is identical to the end elevation shown in FIG. 4 of the upper slip. The lower slip wedge 104 telescopes along a lower end portion into a tubular housing 115. The lower end portion of the wedge 104 is threaded into an adjustable lock ring 120 which is secured by shear pins 121 with the housing 115. The upper end edge of the ring 120 is engageable with an internal annular flange 122 provided within the upper end of the housing 115 limiting upward movement of the wedge 104 relative to the housing to the position shown in FIG. 2C. The lower end edge of the lower slip 21 is engageable with the upper end edge of the housing 115 so that downward movement of the wedge into the housing forces the expander surface 112 along the wedge into the lower slip 21 expanding or spreading the slip. The threaded connection between the ring 120 and the lower end portion of the wedge 104 permits a degree of adjustment of the amount of the lower end portion of the wedge which is initially telescoped into the housing which initially adjusts the extent of contraction or expansion or the diameter of the lower slip 21 in the initial unset condition of the packer. The housing 115 has a bleed port 123.

As shown in FIG. 2C, the lower end portion of the housing 115 is threaded on an upper end portion of a bottom sub 124 which is threaded along a lower end portion 125 for the connection of a tubing string below the packer if desired. The bottom sub has an enlarged upper bore portion 130 providing space around the packer mandrel 123 for a snap ring 131 mounted on the packer mandrel used in releasing the packer from a well bore. Below the bore portion 130 an o-ring seal 132 is disposed in an internal annular recess of the bottom sub to seal between the bottom sub and the outer surface of the packer mandrel. Below the o-ring seal 132 the bottom sub is provided with an internal annular locking recess 133 which is engageable by a plurality of circumferentially spaced collet fingers 140 formed in the lower end portion of the packer mandrel 123. As better seen in FIG. 7 showing the lower end portion of the packer mandrel, the mandrel is provided with a plurality of circumferentially spaced elongated slots 135 defining between the slots collet fingers 140 each of which has a locking boss 141 which is engageable with the locking recess 133 within the bottom sub 124. While the packer is being run and during the time the packer is set, the lower end of the packer mandrel 123 is connected with the bottom sub 124 by a plurality of circumferentially spaced shear screws 142 threaded through the bottom sub into holes 143 along the lower end portion of the packer mandrel below the collet fingers 140. The collet fingers 140 and the shear pins 142 cooperate during the setting and operation of the packer to prevent longitudinal movement of the packer mandrel relative to the bottom sub.

For purposes of running and setting the packer 10, the top sub 24 of the packer is connected by shear pins 150 to a running tool 151 as shown in fathom lines in FIG. 2A. The running tool has a setting sleeve 152 which telescopes downwardly over the top sub engaging the upper end edge of the packer setting sleeve 34. The running tool has a probe or stinger 153 which extends the length of the packer mandrel 23 to the lower end of the mandrel within the collet fingers 140 locking the fingers outwardly so that the combined holding force of the collet fingers and the shear pins 142 lock the packer mandrel with the bottom sub 124 during the running and setting of the packer. A suitable standard running tool which may be used with the packer 10 is illustrated and described in U.S. Pat. No. 2,799,343, issued July 16, 1957 to M. B. Conrad. To adapt the running tool to the packer 10, it is simply fitted with a suitable extension tube or stinger 153 which is secured at the upper end with the running tool and has an enlarged lower end fitted within the packer mandrel collet fingers 140 thereby preventing inward movement of the collet fingers so that the bosses 141 cannot come out of the locking recess 133 within the packer bottom sub. The packer 10 is lowered in the well bore on the running tool 151 with the various elements of the packer positioned as illustrated in FIGS. 2A–2C.

When the packer 10 supported on the running tool 151 is at the desired depth within the well bore above the casing perforations 15 in the well configuration represented in FIG. 1, the running tool is operated by firing the charge which forces the setting sleeve 152 of the running tool downwardly against the upper end edge of the packer setting sleeve 34. The downward force on the setting sleeve 34 shears the pins 35 releasing the setting sleeve from the top sub 24. Setting sleeve 34 is then forced downwardly by the running tool setting sleeve applying a downward force to the top slip support 40 which is driven downwardly against the top slip 20 which drags along the inner wall surface of the casing 11. The downward force applied to the top slip is transmitted through the collet wedge 51, the collet wedge housing 63, the upper element retainer 74, all of the elements of the packing assembly 22, the release ring 100, and the lower retainer cap 101 to the lower slip wedge 104. The downward force on the lower slip wedge 104 drives the slip wedge downwardly relative to the lower slip 21 and the housing 115 which is secured to the bottom sub 124 locked by the mandrel collet fingers 140 with the packer mandrel 23. Since the packer mandrel is secured by shear pins to the running tool while the running tool setting sleeve is moving downwardly the relative force applied against the bottom slip wedge 104 drives the slip wedge downwardly telescoping the slip wedge into the housing 115, the housing being held against downward movement because of the locked relationship of the packer mandrel. The downward force on the slip wedge is applied to the ring 120 which is secured by shear pins 121 with the housing 115. This downward force shears the pins 121 thereby releasing the ring 120 and the slip wedge 104 for downward movement telescoping the lower end portion of the wedge 104 into the housing 115. Since the upper end of the housing 115 holds the lower slip 21 against downward movement the telescoping of the wedge 104 downwardly expands the slip 21 until the teeth 114 on the slip tightly engage the inner wall of the casing 11. The slip wedges between the expander wedge 104 and the casing wall stopping the expander wedge 104 from any farther movement downward. Thus the lower slip 21 is set. During the setting of the lower slips, all of the elements on the packer from the setting sleeve 34 at the upper end down through and including the expander wedge 104 with the ring 120 move downwardly simultaneously on the packer mandrel 23.

With the lower slip 21 fully expanded against the wall of the casing 11 and the lower slip expander wedge 104 wedged within the lower slip, the wedge 104, the lower retainer 101, and the release ring 100 cannot move downwardly and therefore the continued downward force from the setting sleeve 34 through the elements of the seal assembly 22 continue downward movement effecting the expansion of the seal assembly. The downward force through the elements of the seal assembly causes a stacking effect along the seal assembly elements as the elements are longitudinally compressed on the packer mandrel 23. The lower shoe support 85 and the lower back-up shoe 84 spread radially with the peripheral edge of the back-up shoe engaging the casing wall surface. The lower member 83 has spread radially and compresses longitudinally substantially closing the internal annular recess **83*a* within the member 83 permitting the member to compress longitudinally and spread radially sufficiently to retard extrusion of the lower end element 82 downwardly between the mandrel and the casing wall. The anti-extrusion ring 90 within the member 83 is urged toward the internal corner between the back-up shoe 84 and the outer surface of the packer mandrel 23 with the anti-extrusion ring preventing extrusion along the mandrel of the inner portion of the member 83. The continued downward compressive force against the element assembly longitudinally compresses and radially expands the center element 81 and the end elements 82. The high temperature and pressure which may be in excess of 600° F. and 5000 psi causes the center and end elements to somewhat flow as they are compressed longitudinally and expanded radially in the space between the packer mandrel and the casing wall surface. The center element 81 is a somewhat softer, more flowable material than the end elements 82 causing the center element to assume the shape of the space between the mandrel and casing wall for fully sealing off such space between the end elements. The action of the lower back-up shoe 84 and the anti-extrusion ring 90 will however preclude any flowing of the material of the center and end elements 81 and 82 and thus confine them to the space between the mandrel and casing wall for effecting a full and complete seal. As the downward compressive force continues and the center and end elements are fully compressed and expanded within the space available between the mandrel and casing wall, the upper member 83, the upper back-up shoe 84, and the upper shoe support 85 compress longitudinally and expand radially in the same manner as such lower elements providing a seal at the upper end of the element assembly between the mandrel and casing wall preventing any upward extrusion of the softer materials of the elements 81 and 82. The anti-extrusion ring 90 similarly precludes extrusion along the outer surface of the mandrel 23**. The natures of the materials of the packer assembly elements prevent the elements from becoming hard and brittle at the elevated temperatures and pressures.

After the elements of the packer seal assembly 22 are fully compressed longitudinally and expanded radially as described, the upper element retainer 74, the wedge housing 63, and the upper slip expander wedge collet 51 can move no farther downwardly. Thus, continued downward force on the setting sleeve 34 drives the slip retainer member 40 downwardly forcing the top slip 20 along the collet wedge expander surfaces 55. The support ring 62 within the collet wedge fingers prevents the collet wedge fingers from moving inwardly and therefore the downward movement of the slip 20 along the expander surfaces 55 expands the one-piece slip 20 radially outwardly against the casing wall to the position shown in FIGS. 8A–8B. Because the ring 60 rests on the packer mandrel 23 and the collet fingers 52 fit tightly around the ring 62 the driving of the slip 20 along the collet finger expander surfaces tightly wedges the slip between the collet finger expander surfaces and the casing wall, thereby setting the top slip 20. With the top slip 20 wedged tightly against the casing wall, the setting sleeve 34 and the slip retainer 40 have moved to a lower end position along the packer mandrel 23 at which the inner teeth within the locking slip segments 43 are engageable with the external thread 44 along the packer mandrel. The reaction force upwardly against the top slip 20 from the compressed packer seal assembly 22 tending to release the top slip is transmitted through the member 40 to the slip segments 43 which then tightly grip the threads 44 along the packer mandrel because of the tapered surfaces within the member 40 and along the slip segments. The slip segments are retained in the member 40 by the retainer ring 43A in the member at the upper end of the slip segments. The slip segments thus lock the member 40 against upward movement so that the top slip 20 is locked at the set position holding the packer assembly 22 compressed and expanded and the lower slip 21 set. It will be seen that by the holding effect of the running tool on the packer mandrel 23 while simultaneously driving setting sleeve 34 downwardly with the running tool setting sleeve 152 the lower slip 21 is first set, the packer seal assembly 22 is compressed longitudinally and expanded radially next, and lastly the top slip 20 is set.

After fully setting the packer, the continued downward force effectively applied in the running tool to the setting sleeve 152 causes a reaction force on the running tool mandrel shearing the pins 150 releasing the running tool from the top sub 24 of the packer 10. With the running tool released, the tool is retrieved to the surface leaving the packer in the well bore set in the condition represented in FIGS. 8A–8C. With the stinger or probe 153 on the running tool withdrawn along with the running tool, the shear pins 142 hold the packer mandrel 23 relative to the bottom sub 124 so that the mandrel cannot move upwardly to unset and release the packer. Suitable standard procedures and equipment may then be used to connect a production tubing string 14 into the packer for flowing well fluids from below the packer to the surface. A suitable tool for the purpose of connecting the production tubing into the packer is illustrated in the Composite Catalog of Oil Field Equipment and Services, 1974–1975 edition, published by World Oil, Houston, Texas, at Page 3928 which shows a seal unit insertable into the packer mandrel and engageable by a J-slot with the packer mandrel lug 31 in the top sub 34. A lower extension tube on the seal unit fits within the collet fingers 140 along the lower end of the packer mandrel 23 preventing the contraction of the collet fingers so that both the collet fingers and the shear pins 142 prevent release of the packer in the event of a high fluid pressure differential across the packer along the well bore.

When removal of the packer is desired, the production tubing and seal unit coupled into the packer are first disengaged from the packer and pulled. A pulling tool is then run into the packer for connection with the packer mandrel at the lug 31. The pulling tool may comprise the J-slot seal units used for connection of the production tubing into the packer with the lower extension tube or stinger on the seal unit removed so that the collet fingers 41 are free to release in the lower end of the packer mandrel 23. The previous reference at Page 3928 of the composite of Oil Field Equipment and Services, supra, clearly illustrates that the lower tubing extension on the seal unit is readily unscrewed from the main body of the seal unit. With the pulling tool engaging the top sub 24 of the packer mandrel an upward force on the pulling tool applied to the packer mandrel through the lugs 31 releases the top slip 20 first, then permits relaxation and contraction of the packer seal assembly 22, and lastly releases the bottom slip 21. The upward force of the pulling tool on the packer mandrel 23 first shears the pins 142 releasing the lower end portion of the packer mandrel from the bottom sub 124. After the pins 142 are sheared, the upward force on the packer mandrel 23 cams the collet finger locking bosses 141 inwardly from the bottom sub locking recess 133 fully releasing the packer mandrel 23 to move upwardly. The upward force of the packer mandrel lifts the locking slip segments 43 upwardly in the support ring 40, disengaging the threads 44 of the packer mandrel 23 from the slips 43 because the slips 43 move slightly upwardly along the outwardly flared surface 42 within the ring 40. As the packer mandrel 23 is pulled upwardly when the snap ring 72 moves into the support ring 62, the support ring 62 is forced upwardly shearing the pins 61 so that the support ring is lifted farther into the top slip 20 from beneath the locking heads of the fingers on the collet wedge 51. When the ring 62 moves out from underneath the collet wedge 51 the fingers 52 are free to compress inwardly so that the top slip 20 is relaxed and contracts around the inwardly compressed collet fingers releasing the top slip from the casing wall. As soon as the top slip is released from the casing wall, the holding effect of the slip which while the packer is set has prevented upward movement of the wedge housing 63 and the top element retainer 74 is released so that the compressed and expanded packer seal assembly 22 relaxes contracting the seal assembly elements from the casing wall as the elements extend longitudinally along the packer mandrel returning to some extent to the original extended contracted condition of the packer seal assembly. Continued upward movement of the packer mandrel 23 after the top slip 20 is released and the packer seal assembly elements relax and release, the packer mendrel 23 is raised to the position at which the snap ring 131 engages the release ring 100 for releasing the lower slip 21. As the packer mandrel moves upwardly to the position at which the lower slip is released, the snap ring 131 moves out of the bore 130 of the bottom sub, moves along the housing 115, and moves along the enlarged bore 105 of the bottom slip wedge 104 until the snap ring engages the lower end face of the release ring 100. When the snap ring 131 engages the ring 100, the ring is lifted closing the gap between the ring flange 102 and the flange 103 of the bottom seal retainer 101. As the ring moves upwardly, the upper end of the ring extends from the upper end of the retainer 101 producing a gap between the lower face of the bottom backup shoe 85 and the upper end of the retainer 101. This gap allows the back-up shoe support 85 and the back-up shoe 84 to fold downwardly and inwardly along the ring 100 above the upper end of the retainer 101 as the upper end edge of the ring 100 lifts the elements of the packer seal 22 with the mandrel. Without the gap between the upper end of the retainer 101 and the lower face of the shoe support 85, the metal back-up shoe 84 could become jammed or wedged between the packer and the casing wall, thereby interfering with the release and removal of the packer. The gap provides adequate space for the shoe support and back-up shoe to fold radially inwardly as the elements fold downwardly thereby eliminating the possibility of wedging along the casing wall.

As the lifting of the packer mandrel 23 continues in releasing the packer, when the flange 102 on the release ring 100 engages the flange 103 within the lower retainer 101 the retainer 101 is lifted which raises the wedge 104 pulling the wedge expander surface 112 from within the lower slip 21. As the wedge 104 is pulled upwardly relative to the lower slip 21, the lower slip releases from the casing wall and contracts inwardly at which time the packer 10 is fully released from the casing for removal from the well bore. When the ring 120 along the lower end of the wedge 104 engages the internal annular flange 122 in the housing 115 the housing is lifted along with the bottom sub 124 to which the housing is connected. Thus the packer components are stretched or extended along the packer mandrel 23 with the packer fully released to positions represented in FIGS. 9A–9D. As the packer is pulled upwardly, the snap ring 72 on the packer mandrel 23 is engaged with the ring 62 and the snap ring 131 along the lower portion of the packer mandrel is engaged with the release ring 100, holding the bottom sub 124 and all of the components of the packer along the mandrel together in the telescopically extended positions of FIGS. 9A–9D as the packer is retrieved from the well bore.

It will now be seen that a new and improved packer for a well bore has been described and illustrated. It will also be seen that a new and improved packer seal assembly for a well packer has been described and illustrated. The packer is adapted to be releasably set in and removable from a well bore utilizing simple inexpensive one-piece C-shaped upper and lower slips which are included in upper and lower slip assemblies not requiring the normal close manufacturing dimension tolerances found in other comparable packers. The packer seal assembly effectively seals at the temperatures in excess of 600° F. and pressures on the order of 5000 psi.

What is claimed is:

1. A well packer comprising: a tubular mandrel; a longitudinally compressible radially expandible seal assembly on said mandrel for sealing around said mandrel with a casing wall around said packer; deformable upper and lower retainer means on said mandrel at upper and lower ends of said seal assembly for radial expansion against said casing wall to contain said seal assembly at high temperatures and pressures; ring means at the lower end of said lower retainer means including an outer ring member movable longitudinally away from said lower retainer means to produce an external annular gap around said mandrel below said lower retainer means to receive downward and inward folding of said lower retainer means when pulling said packer to relieve wedging of said lower retainer means against said casing wall; an upper slip assembly on said mandrel for releasably locking with a casing wall around said packer adapted to set last and release first including a collet wedge and slips slidable along said collet wedge; a lower slip assembly on said mandrel for releasably locking with a casing wall around said packer adapted to set first and release last including an expander wedge slidable into lower slips; and each of said slip assemblies including a one-piece C-shaped slip having external teeth to grip said casing wall.

2. A well packer in accordance with claim 1 where said seal assembly includes a soft center element and sequentially harder elements along said mandrel on opposite sides of said center element.

3. A well packer in accordance with claim 2 where said seal assembly includes retainer shoes on each side of said center element adapted to partially collapse longitudinally when subjected to a compressive force along said mandrel.

4. A well packer in accordance with claim 3 where each of said retainer shoes includes an internal annular recess and an annular end flange overlapping the adjacent seal assembly element to permit each said shoe to partially collapse longitudinally and expand radially to contain said seal assembly against extrusion in response to a compressive force along said mandrel.

5. A well packer in accordance with claim 4 where said seal assembly has a back-up shoe at each end of said seal assembly outward of each of said retainer shoes and a shoe support at each end of said assembly outward of each of said back-up shoes.

6. A well packer in accordance with claim 5 where said seal assembly includes an anti-extrusion ring within each of said retainer shoes to seal around said mandrel at each of said retainer shoes, said ring being adapted to permit said mandrel to slide through said ring and said ring being brittle to fracture responsive to a binding force to free said mandrel to move.

7. The well packer of claim 6 where said seal assembly is of materials chemically resistant to well fluids and resistant to temperatures in excess of 600° F. and adapted to seal around said mandrel with a casing wall at pressures of at least 5000 psi.

8. A well packer in accordance with claim 7 where said center element comprises fluorocarbon elastomer, said end elements and said retainer shoes comprise glass filled polytetra fluoro ethylene, said back-up shoes and said support shoes comprise soft ductile metal, and said anti-extrusion rings comprise polyphenylene sulfide.

9. A well packer for sealing in a well bore with a casing wall comprising: a tubular mandrel; means at a first end of said mandrel for releasably securing said mandrel with running and setting tools; a seal assembly on said mandrel adapted to expand radially responsive to longitudinally compressive forces along said mandrel; a bottom sub on said mandrel; means releasably securing a second end portion of said mandrel with said bottom sub; a lower slip assembly housing secured with said bottom sub around said mandrel releasably secured with said lower slip assembly housing; a lower C-shaped one-piece slip on said lower slip expander wedge adapted to expand radially responsive to a longitudinal force against said expander wedge toward said lower slip assembly housing; a lower seal assembly retainer secured between said lower slip assembly expander wedge and said seal assembly; an upper seal assembly retainer on an opposite side of said seal assembly on said mandrel; an anti-extrusion ring in said upper and lower retainers around said mandrel outer surface to prevent extrusion of said seal assembly along said mandrel surface, said rings being adapted to permit said mandrel to slide therethrough under high pressure and temperature and being brittle sufficiently to fragment responsive to a binding force between said ring and said mandrel to free said mandrel to move; each retainer having an internal annular recess and an annular end flange whereby each said retainer compresses longitudinally and expends radially for sealing between said mandrel surface and said casing wall to contain said seal assembly under high pressure and temperature; said lower retainer having means for telescopic extension to produce an external annular gap for downward and inward folding of said lower retainer to prevent wedging of said retainer between said mandrel and said casing wall when pulling said packer; an upper slip assembly housing secured with said upper seal assembly retainer around said mandrel; an upper slip assembly expander wedge collet secured with said upper slip assembly housing; a support ring releasably secured between said collet and said mandrel for holding said collet against contraction; an upper C-shaped one-piece slip around said mandrel above said collet wedge adapted to expand radially responsive to a force on said slip toward said collet wedge; a locking slip segement support ring around said collet above said upper slip; a plurality of locking segments within said support ring for engaging said mandrel to lock said upper slip in an expanded position; and a setting sleeve releasably secured with said mandrel and connected with said locking slip segment support ring for applying a setting force to said lower and upper slips and said seal assembly.

10. A well packer in accordance with claim 9 including an upper snap ring on said mandrel for engagement with said support ring within said collet wedge of said upper slip assembly and a lower snap ring on said mandrel engageable with said release ring of said lower slip assembly, said upper snap ring being longitudinally positioned relative to said lower snap ring to engage said support ring of said upper slip assembly to release said upper slip and thereafter permit said packer seal assembly to relax and space out longitudinally prior to engagement of said lower snap ring with said release ring of said lower slip assembly to release said lower slip.

11. A well packer in accordance with claim 10 including a release ring in said lower slip assembly adapted to move longitudinally toward said packer seal assembly prior to engagement of said release ring with said lower seal assembly retainer to produce an annular gap between said shoe support at the lower end of said packer seal assembly and said lower packer seal assembly retainer for downward and inward folding of said back-up shoe at the lower end of said packer seal assembly to avoid obstructions along said well bore when pulling said packer.

12. A well packer comprising: a packer mandrel having a central bore therethrough and means at one end for connection with running and pulling tools and a production tubing string: means on said mandrel for releasably locking said packer in a well bore; and a packer seal assembly for sealing between a well bore wall and said packer mandrel including a tandem arrangement of annular elements of varying degrees of hardness and resiliency comprising a soft center element, end elements on opposite sides of said center element each harder than said center element, support shoes on opposite sides of said end elements each harder than said end elements, back-up shoes at opposite ends of said support shoes formed of relatively thin ductile material for radially spreading against a well wall surface, an anti-extrusion ring along each end of said seal assembly within said support shoes against an inward face of said back-up shoe, a shoe support at each end of said seal assembly outward of each of said back-up shoes, and ring means on said mandrel below the lower of said shoe supports adapted for telescopic extension to produce an external annular gap below the lower of said back-up shoes and said support shoes to permit said lower shoes to fold downwardly and inwardly to prevent jamming said shoes between said mandrel and said well bore wall.

13. A well packer in accordance with claim 12 wherein each of said support shoes is adapted to compress longitudinally and expand radially having a lip portion extending over the adjacent end element and internal annular spaced recesses the outward recess enclosing said anti-extrusion ring and the inward recess providing a void for facilitating longitudial compression of said support shoe.

14. A well packer in accordance with claim 13 wherein said center element comprises a fluorocarbon elastomer, said end elements comprise a glass filled polytetra fluoro ethylene, said support shoes comprise a glass filled polytetra fluoro ethylene having a glass content greater than said end element, and said back-up shoe and said shoe support members comprise heat treated ductile metal and said anti-extrusion ring comprises polyphenylene sulfide.

15. A seal assembly for a well packer comprising a plurality of annular elements arranged in end-to-end array and of varying degrees of hardness and resiliency including a soft center element, harder end elements on opposite sides of said center element, a support shoe at each opposite end of each of said end elements, said support shoes being harder than said end elements and each having an internal annular void space for longitudinal compression and radial expansion of said end elements, a back-up shoe at each end of each of said support shoes formed of a ductile sheet materia, an internal annular anti-extrusion ring within each of said support shoes for engagement into a support mandrel against said back-up shoe adjacent said support shoe, and a shoe support at each end of said assembly outward of each of said back-up shoes.

16. A well packer seal assembly in accordance with claim 15 wherein said center element comprises flurorcarbon elastomer, said end elements comprise a glass filled polytetra fluoro ethylene, said shoe support members comprise a glass filled polytetra fluoro ethylene having a higher glass content than said end elements, said back-up shoes and said shoe supports comprise ductile metal, and said anti-extrusion rings comprise polyphenylene sulfide.

17. A well packer comprising: a tubular mandrel having a top sub provided with means for connecting said mandrel with running and pulling tools and a production tubing seal unit; a plurality of locking collet fingers having external locking bosses along a lower end portion of said mandrel; a bottom sub on said mandrel having an internal annular locking recess engageable by said mandrel collet fingers; a lower slip assembly housing connected with said bottom sub around said mandrel; a lower slip assembly expander wedge telescoped along a lower end portion into said lower slip assembly housing; a locking ring within said lower slip assembly housing connected with said lower end portion of said expander wedge; shear pin means between said locking ring and said lower slip assembly housing for releasably locking said expander wedge relative to said housing; a one-piece C-shaped lower slip on said expander wedge above said housing for expansion by said wedge when said wedge is driven toward said housing; a lower seal assembly retainer ring connected with an upper end portion of said expander wedge having an internal flange along an upper end portion thereof; a lower slip assembly release ring within said lower retainer ring and provided with an external annular flange engageable with said flange of said retainer ring, said retainer ring flange and said release ring flange being longitudinally spaced apart before said packer is pulled to produce an annular gap above said lower retainer ring to receive folded-down seal assembly retainer means around said mandrel when pulling said packer; a snap ring on said mandrel engageable with said lower slip assembly release ring when said mandrel is pulled upwardly for releasing said lower slip; a seal assembly on said mandrel above said lower seal retainer ring including a plurality of seal elements in end-to-end array; said seal assembly comprising a soft plastic center element, harder plastic end elements, still harder plastic annular retainer shoes each having internal void space for longitudinal compression and radial expansion of said retainer shoes, internal annular anti-extrusion rings in said retainer shoes, a back-up shoe at each end of said seal assembly at an outward end of each of said retainer shoes for radially spreading into engagement with a surrounding well bore surface, and an annular metal shoe support at each end of said seal assembly outward of each of said back-up shoes; an upper seal assembly retainer ring above said seal assembly; an upper slip assembly housing connected with said upper seal assembly retainer ring around said mandrel; an upper slip assembly expander collet wedge tele-scoped into said upper slip assembly housing; a support ring releasably secured around said housing within said collet wedge for holding said collet wedge outwardly when said upper slip assembly is set and releasing said collet wedge for release of said upper slip assembly; and upper one-piece C-shaped slip around said mandrel engageable with said collet wedge for expansion of said slip when said slip is driven downwardly toward said collet wedge; external longitudinal threads along said mandrel within said upper slip assembly; a locking slip segment retainer ring around said mandrel movable on said mandrel toward said upper slip; a plurality of locking slip segments within said retainer ring engageable with said threads on said mandrel for locking said retainer ring to lock said upper slip when said slip is expanded; an upper snap ring on said mandrel within said upper slip assembly engageable with said support ring within said collet wedge before said lower snap ring on said mandrel engages said release ring of said lower slip assembly to release said upper slip assembly first when said packer is pulled; and a setting sleeve around said mandrel connected along a lower portion with said slip segment retainer ring and releasably connected along an upper portion with said top sub.

* * * * *